US005348523A

United States Patent [19]

Blount

[11] Patent Number: 5,348,523

[45] Date of Patent: Sep. 20, 1994

[54] WEIGHT LIFTER'S BENCH PAD

[76] Inventor: Gregory M. Blount, 12 Crestwood Dr., Cabot, Ark. 72023

[21] Appl. No.: 994,504

[22] Filed: Dec. 21, 1992

[51] Int. Cl.[5] ..... A63B 21/00

[52] U.S. Cl. ..... 482/104; 5/900.5; 5/652

[58] Field of Search ..... 482/104, 134, 94, 92, 482/142; 5/621-624, 630, 632, 652, 900.5; 128/870; 606/240, 242, 237

[56] References Cited

U.S. PATENT DOCUMENTS

| | | | |
|---|---|---|---|
| 3,266,061 | 8/1966 | Fuechsel | 5/900.5 |
| 3,885,257 | 5/1975 | Rogers | 5/900.5 |
| 3,885,258 | 5/1975 | Regan | 5/900.5 |
| 4,571,761 | 2/1986 | Perlin | 5/652 |
| 4,598,908 | 7/1986 | Morgan | 482/104 X |
| 4,621,809 | 11/1986 | Pearl . | |
| 4,775,150 | 10/1988 | Graham . | |
| 4,905,330 | 3/1990 | Jacobs . | |
| 4,972,535 | 11/1990 | Goldman | 5/900.5 |
| 5,007,633 | 4/1991 | Lemire . | |
| 5,039,090 | 8/1991 | Roosevelt . | |

FOREIGN PATENT DOCUMENTS

| | | |
|---|---|---|
| 3208298 | 9/1983 | Fed. Rep. of Germany . |
| 254571 | 7/1926 | United Kingdom . |

*Primary Examiner*—Richard J. Apley
*Assistant Examiner*—Glenn E. Richman
*Attorney, Agent, or Firm*—Charles A. Bevelacqua

[57] ABSTRACT

There is disclosed a bench pad for a weight lifter's bench which has a first elongate portion of a first substantially uniform predetermined width, a second portion disposed longitudinally of the first elongate portion and having a second substantially uniform predetermined width and a third portion disposed between the first elongate portion and the second portion and connected to each of them. The third portion is positioned to be located under the shoulders and cervical area of a person lying supine on the bench pad. A first end of the third portion is connected to the first elongate portion and has a width substantially equal to the width of the adjoining end of the first elongate portion and a second end of the third portion is connected to the second portion and has a width substantially equal to the width of the adjoining end of the second portion. The third portion has a middle portion of a width substantially reduced from the width of each of its ends and has a width which gradually reduces from each of its ends toward such middle portion. Arcuate recessed portions to help support and stabilize the head and hips of a person lying supine on the bench pad and a restraining device to help restrain excessive arching of a weight lifter's back away from the bench pad are also disclosed.

13 Claims, 2 Drawing Sheets

WEIGHT LIFTER'S BENCH PAD

This invention relates to exercise and body building apparatus and particularly to a bench pad for supporting and stabilizing the head, back and hips of a person performing weight lifting exercises such as flat bench, press bench and incline bench exercises and to a restraining belt for such a bench pad.

BACKGROUND OF THE INVENTION

It is well known for persons to exercise and develop body muscles by performing exercises involving the use of various weights which are raised and lowered in specified movements to develop particular muscles of the body.

One type of exercise is the bench press in which the weight lifter lies supine on a horizontal press bench with feet placed on the floor and raises and lowers a set of weights attached to the ends of a bar which he grasps in his hands. Usually the bar and weights, comprising a barbell, are initially held by a weight support structure above the body of the weight lifter. In performing the exercise the weight lifter lifts the bar and weights out of the weight support structure, slowly lowers the bar to touch his or her chest, then raises the weights until his or her arms are fully extended. The barbell is then raised and lowered successively for a series of repetitions.

Another exercise is known as the "bent over one arm dumbbell pull". In this exercise the weight lifter positions himself parallel to the bench, then lies in a prone position with one side of his or her body and one leg lying on a flat bench, the other leg extending over the edge of the bench with its foot on the floor. He or she then picks up a weight, usually in the form of a dumbbell, raises it straight up to his or her chest and then lowers it to the floor. This exercise is usually also repeated.

Another exercise is known as the "dumbbell fly" exercise in which the weight lifter lies flat on his or her back on a flat bench with a dumbbell in each hand. The dumbbells are raised from the floor in an upward arcuate motion until they touch at a point above the center of the weight lifter's body and are then lowered to the floor again.

These and other weight lifting exercises are repeated to exercise and develop various arm and chest muscles. Certain exercises are performed on an incline bench which has one end higher than the other.

In the past the pads on benches used for weight lifting were relatively narrow, usually less than a foot and about three and a half to four and a half feet in length. They usually consisted of a rectangular board or other slab with some type of resilient foam material for padding to help protect the body of the weight lifter and a cover, such as a vinyl sheeting, to protect the foam. The bench pad is supported above the floor on a framework that is supported on legs to the appropriate height. Press benches and incline benches include a weight support structure, flat benches do not include a weight support structure.

Several problems occur during performance of weight lifting exercises such as those described above because of the heavy weights involved and the forces imposed on the body.

First, there is a tendency for the body to shift and slide on the bench causing undesirable strains on various parts of the body and causing the weight lifter to lose balance and control of the barbell and detracting from his or her performance of the exercise or maneuver in the prescribed and most desirable form.

Second, there is contact between parts of the bench and parts of the body which can interfere with proper execution of the exercise. For example, on a typical bench pad of rectangular configuration, the bench pad interferes with the arms and shoulders as the barbell is being raised from and lowered to the weight lifter's chest, preventing full expansion of the pectoral muscles, interfering with execution of proper form and even causing "bench burns" or bruises on the shoulder blade area from contact with the edges of the bench pad.

Third, there is a likelihood of the dumbbell striking the bench pad during execution of bent over one arm dumbbell pulls interfering with form of execution and destroying the rhythm and balance of the weight lifter.

Prior attempts have been made to correct some of these problems but they have generally been directed to support in a longitudinal direction and have left open the problems associated with lateral instability and shoulder blade interference. Prior bench pads are still constructed in a generally rectangular configuration, particularly in the critical shoulder and cervical areas.

This invention addresses the problems discussed above. It discloses a bench pad which provides lateral support and clearance without diminishing vertical support and protection of the weight lifter's head and back. An optional feature also addresses the problem of an undesirable degree of arching of the back during bench press exercises.

SUMMARY OF THE INVENTION

The present invention provides a bench pad for a weight lifter's bench which has a first elongate portion of a first substantially uniform predetermined width; a second portion disposed longitudinally of the first elongate portion and having a second substantially uniform predetermined width; a third portion disposed between the first elongate portion and the second portion and connected to each of them and positioned to be located under the shoulders and neck of a person lying supine on the bench pad; a first end of such third portion being connected to the first elongate portion and having a width substantially equal to the width of the adjoining end of such first elongate portion; a second end of the third portion being connected to the second portion and having a width substantially equal to the width of the adjoining end of such second portion; such third portion having a middle portion of a width substantially reduced from the width of each of its ends; and such third portion having a gradually reducing width from each of its ends toward such middle portion.

A second aspect of the invention provides a bench pad for a weight lifter's bench comprising a base of substantially rigid material; a resilient contoured cushion pad overlying and supported by such base; and a substantially non-porous cover of relatively thin material overlying and conforming to the top surface of the contoured pad and the edges of such contoured cushion pad and the base; the bench pad being characterized by a reduced width portion which underlies at least a part of the shoulders and cervical body portion of a person lying supine on said bench pad thereby permitting a wider range of motion of the shoulder blades and full expansion of the pectoral muscles during bench press and dumbbell exercises.

According to the invention the resilient cushion pad may be formed with arcuate depressions which serve to support and stabilize the head and hips of a weight lifter lying supine on the pad. The resilient cushion pad may preferably be formed from a single, integral piece of material.

OBJECTS OF THE INVENTION

It is one of the primary objects of this invention to provide a weight lifter's bench pad which will adapt to fit the contours of a human body which come in contact with the pad to support and stabilize parts of the body during weight lifting exercise.

It is another object of this invention to provide a weight lifter's bench pad which will support and stabilize parts of a human body lying supine on such pad in all of the lateral, longitudinal and vertical directions.

Still another object of this invention is to provide a weight lifter's bench pad which provides support and stability to the body of a person lying on the pad to perform weight lifting exercises allowing the person to concentrate on performance of the exercises.

Yet another object of the invention is to provide a weight lifter's bench pad shaped and contoured to reduce the probability of the bench pad interfering with the movement of weights or the weight lifter's body during weight lifting exercises.

Another object of this invention is to provide a weight lifter's bench pad which will allow free movement of a weight lifter's arms and shoulders and full expansion of the pectoral muscles during bench exercises to promote development of those muscles.

A further object of the invention is to provide a weight lifter's bench pad which will substantially reduce or eliminate the incidence of shoulder blade bruises on the body of a weight lifter through contact of the weight lifter's shoulder blades with parts of the bench pad during weight lifting exercises.

It is a still further object of this invention to provide a restraining device for a weight lifter's bench pad which will restrain arching of the weight lifter's torso out of contact with the bench pad during weight lifting exercises.

Another object of this invention is to provide a restraining belt on a weight lifter's bench pad to maintain a weight lifter's lower back and hips in contact with and supported by the bench pad.

These and other objects and advantages of the invention will become more readily apparent to those persons who are skilled in the weight lifting equipment art from the following more detailed description, particularly when such description is taken in conjunction with the attached drawings and the appended claims.

BRIEF DESCRIPTION OF THE DRAWINGS

FIG. 4 also shows an adjustable restraining device.

DESCRIPTION OF THE PREFERRED EMBODIMENTS

Figure 3:
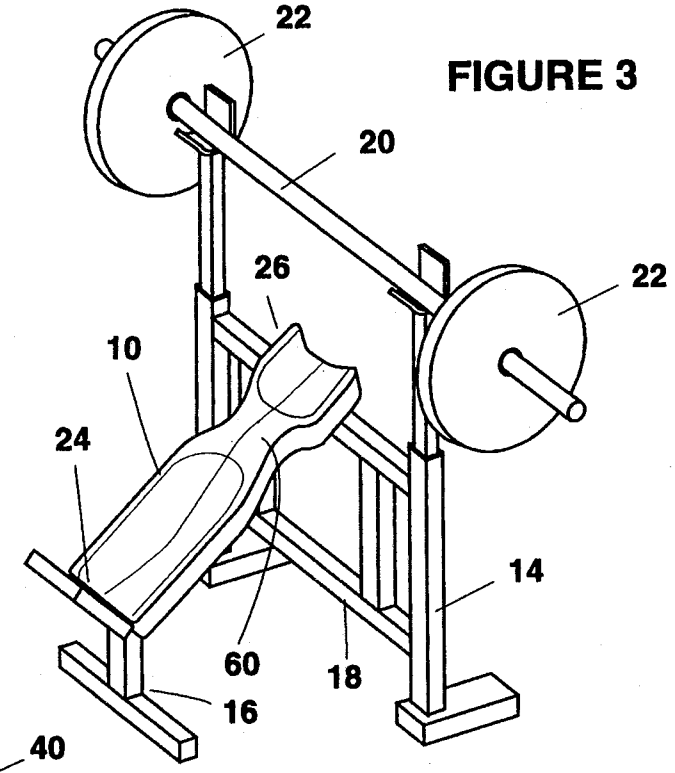
FIG. 3 is an isometric view similar to FIG. 1 but with the bench pad installed on an incline bench frame apparatus.
Figure 1:
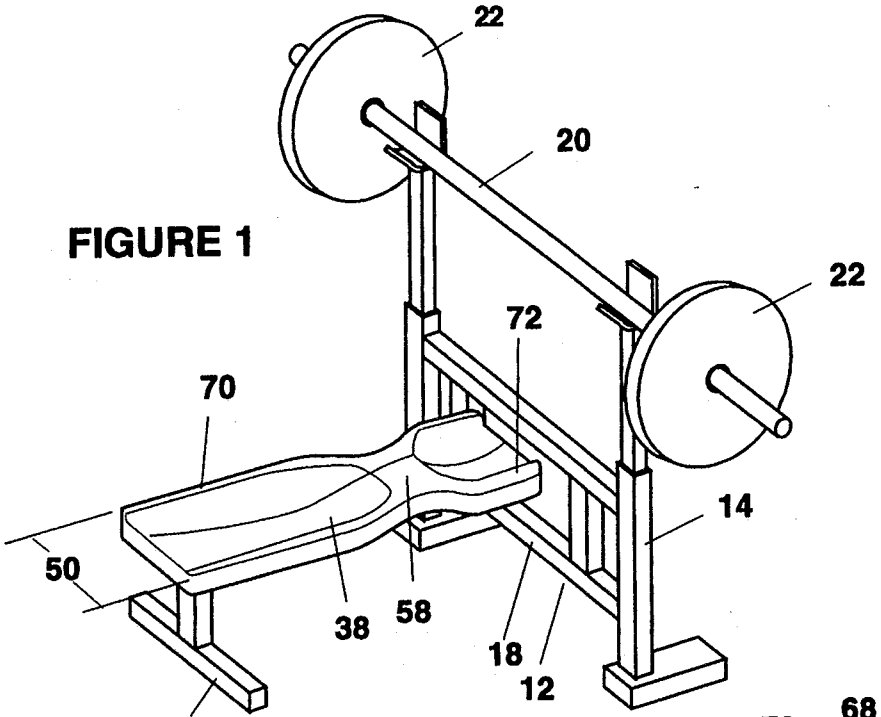
FIG. 1 is an isometric view of the bench pad of the present invention installed on a press bench frame apparatus which has a weight support structure.
Figure 2:
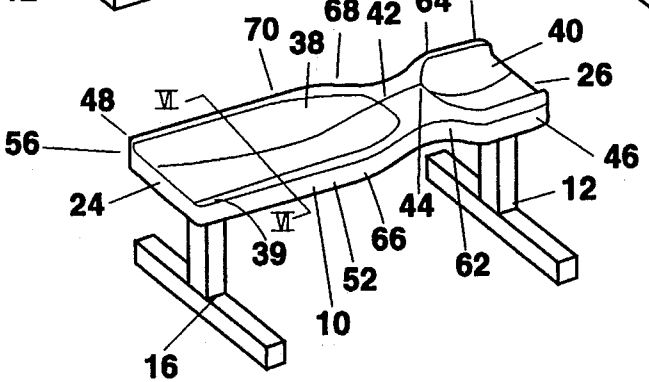
FIG. 2 shows the bench pad of the present invention in a flat bench configuration.

Referring now to the drawings, the bench pad of this invention is indicated generally by the numeral 10. FIG. 1 shows the bench pad mounted in press bench configuration. It includes support structure or framework generally designated 12, and a weight support structure generally designated 14. The support structure 12 includes a lower support portion generally designated 16 and an upper support portion generally designated 18. The drawing shows a set of barbells comprising a bar 20 and weights 22 supported on the weight support structure 14. One or more rigid bench support members running between the lower support portion 16 and the upper support portion 18 extend beneath the bench pad and support it above the ground. One or more such members, indicated by the numeral 30 in FIG. 6, may be provided underneath the bench pad. FIG. 2 shows the bench pad in a flat bench configuration which does not include a weight support structure. FIG. 3 illustrates the bench pad in an incline bench configuration. In this configuration the upper support portion 18 is higher than the lower support portion 16 so that the bench pad is in an inclined position rising upward from the lower end 24 of the bench pad to the upper end 26 thereof.

Figure 6:
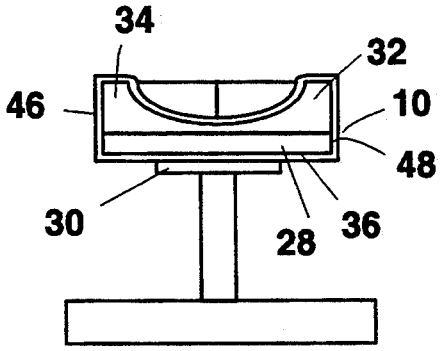
FIG. 6 is a cross-sectional view of the bench pad of the invention taken along line VI—VI in FIG. 1.

As can best be seen in FIG. 6, the bench pad 10 comprises a base member 28 which may be constructed of wood or a wood-like material or any other material suitable for the purpose and capable of supporting the weight of a person utilizing the bench pad for weight lifting. Base member 28 is attached by suitable means, not shown, such as bolts, screws or the like to bench support member 30. A resilient pad 32 is positioned on and supported by base member 28. As will later be more fully described, resilient pad 32 is contoured to support and stabilize the body of a weight lifter lying supine on the pad. A suitable covering 34 of cloth, sheet vinyl or the like is wrapped over the resilient pad and the edges of base member 28 and is secured to the bottom surface 36 of base member 28 by suitable means such as staples or the like. Resilient pad 32 is made from a material such as urethane, polyurethane, foam rubber or the like which are known in the art and are of a density to comfortably support a person lying on the bench, which will remain resilient and not permanently deform in use and which can be readily cut and sculpted to the desired shape and form. The bench pad has a first elongate portion 70 which begins at the lower end 24 of the bench pad 10 and extends toward the end 26 of the bench pad in a substantially even width and height. A second portion 72 of the bench pad adjoins the upper end 26 and is designed to lie under the head and cervical area of a person lying on the bench. A third portion 58 of the bench pad forms a connection and transition between the first elongate portion 70 and the second portion 72 of the bench pad and is designed to be positioned under the shoulders and cervical area of a person lying supine on the bench pad.

As indicated in the drawings, the first elongate portion of the bench pad is provided with a first generally concave portion 38 which is adapted to support and stabilize the hips and lower back portion of a person lying supine on the bench pad while such person is performing weight lifting exercises. A second generally concave portion 40 is provided in the second portion 72 adjacent the upper end 26 of the bench pad to help support and stabilize the head of a person lying on the bench.

Beginning at the lower end 24 of bench pad 10 the first concave portion is relatively wide and shallow and continues toward the upper end of bench pad 10 in a substantially even width. The side edges 46 and 48 of bench pad 10 rise upward from the lower end 24 in a gradual curve to the full height 52 of the pad causing the depth of the concave portion from the top of the edges 46 and 48 to be greater until the side walls reach their full height 52 and from that point the concave portion 38 continues in a substantially even width and depth until it reaches a point which would lie approximately under the buttocks of a person lying supine on the bench pad. Beginning at this point and continuing to a point or apex 42 which would lie approximately along the spine of a person lying supine on the bench pad and at a point approximately below the shoulder blades of such person the width and depth of the first concave portion gradually diminish. Concave portion 40 is widest and has its greatest depth adjacent the upper end 26 of the bench pad and gradually decreases in depth and width to a point or apex 44 which would be located substantially at the base of the skull in line with the vertebrae of a person lying supine on the bench pad. Bench pad 10 has side edge portions 46 on one side and 48 on the other side which are substantially vertical and perpendicular to the surface 36 of base member 28. These side edges 46 and 48 lie generally along a straight line for most of the extent of elongate portion 70 and second portion 72 and are parallel with each other.

The first elongate portion 70 of bench pad 10 has a substantially uniform predetermined width 50. The bench pad also has a substantially uniform height 52 but may be provided with a portion 54 of gradually reducing height adjacent the lower end of the bench pad, as previously described, with the smallest height 56 at the lower end 24 of the bench pad. A third portion 58 of the bench pad lies between the first and second concave portions 38 and 40 respectively and forms a connection between them. This third portion has a middle portion 60 which is of substantially lesser width than the width of the remainder of the bench pad. The middle portion 60 is connected by an arcuate portion 62 to the side edge 46 of the upper end of bench pad 10 and by arcuate portion 64 to the side edge 48 of the upper end of bench pad 10. Similarly, middle portion 60 is connected by an arcuate portion 66 to the side edge 46 of the elongate portion 70 and by arcuate portion 68 to the side edge 48 of elongate portion 70. The reduced width middle portion 60 of the third portion is located to be positioned along a line substantially in line with the middle of the shoulder blades of a person lying on the bench pad to perform weight lifting exercises. The side edges of the third portion 58 form a substantially smooth arcuate transition from the edges 46 and 48 of the elongate portion 70 to the narrow middle portion 60 and back to the edges 46 and 48 respectively of the second portion 72 of the bench pad. It can be readily seen from the drawings that the bench pad 10 is of full height across said middle portion 60 and will provide support for the cervical region of a person performing weight lifting exercises on the bench pad. In this manner the bench pad will provide support for the shoulders of a person but because of the reduced width will allow downward rotation of the shoulders without interfering with such motion so that the arms and shoulders of the weight lifter can be moved downward without restriction enabling the weight lifter to lower the barbell to a point at which the barbell will touch his or her chest. This allows full expansion and development of the pectoral muscles in the manner for which the exercise is intended. This also helps to avoid shoulder burns or bruises which may occur with bench pads of the prior art which have straight sides.

This is also important in performing dumbbell exercises. For example, in the "dumbbell fly" exercise the weight lifter lies supine on a flat bench, picks up a dumbbell lying on the floor on either side of the bench in each hand and with arms fully extended raises the dumbbells evenly until they touch above the center of his or her body. This exercise is repeated to exercise and develop the arm and pectoral muscles. It can be seen that in this exercise also the reduced width middle portion 60 of third portion 58 allows free full movement of the arms and shoulders and will assist in obtaining full expansion of the pectoral muscles. In the "bent over one arm dumbbell pull" exercise the weight lifter stands on one side of the bench pad parallel thereto and places one leg and one side of his or her body on the bench. The foot of his or her other leg is placed on the floor and the free arm is used to pick up a dumbbell from the floor and bring it upward to the weight lifter's chest in a straight pull. In benches of the prior art which did not have the reduced width middle portion 60 there was a likelihood that the dumbbell would strike the bench pad during execution of the one arm dumbbell pulls interfering with the form of execution of the exercise and destroying the rhythm and balance of the weight lifter. By positioning himself or herself so that the dumbbell is raised and lowered in the area adjacent the narrow middle portion 60 of the bench pad, the probability of striking the bench pad with the dumbbell during the exercise is substantially reduced or even eliminated.

Figure 4:
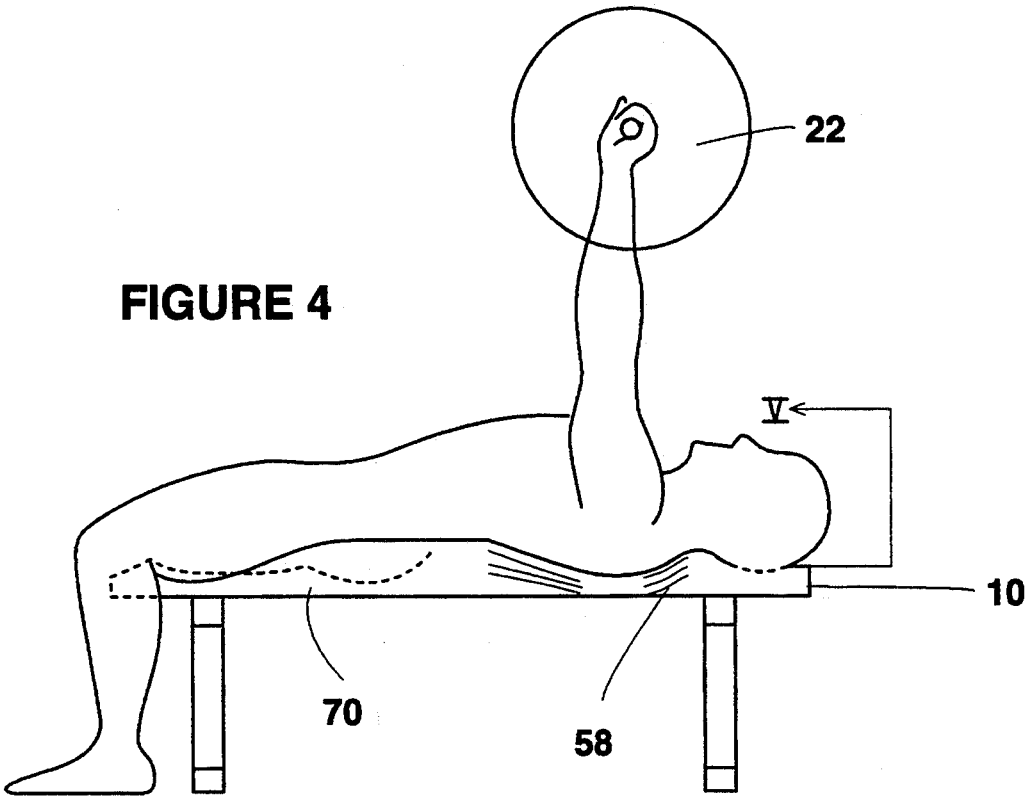
FIG. 4 is a side view of the bench pad of the invention as it would appear in actual use with a weight lifter's body indicated in outline and with the frame apparatus removed for clarity.
Figure 5:
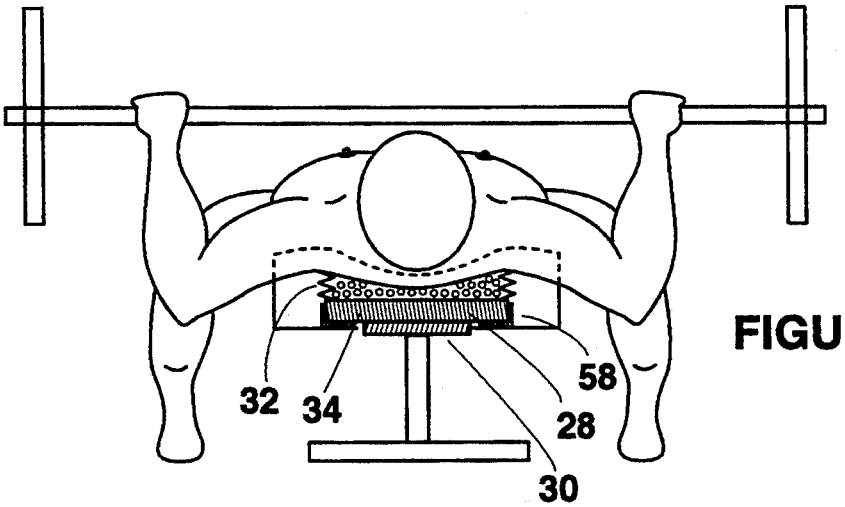
FIG. 5 is a cross-sectional view of the bench pad taken along the line V—V in FIG. 4 as it would appear in use and with a weight lifter's body shown in phantom with shoulders in a lowered position as when the bar bell is lowered to the weight lifter's chest and with the frame apparatus removed for clarity.

In using the bench pad of the invention the weight lifter gains substantial support for the shoulders and cervical area which rests on the full height portion 60 of the third portion 58 of the bench pad. The head of the weight lifter is cradled and stabilized by the concave depression 40 near the top of the bench pad and the hips and lower back are cradled and stabilized by the concave portion 38 in the elongate portion of the bench pad. First this provides suitable support for these areas of the body, second it prevents shifting and sliding of the weight lifter's body on the bench pad allowing the weight lifter to concentrate on the exercise and as previously described avoids interference between the weight lifter's arms and shoulders and the edges of the bench pad so that the arms and shoulders can be freely moved to raise and lower the weights being worked with and full expansion of the pectoral muscles can be obtained. This can best be seen in FIGS. 4 and 5.

Although it is not intended that the invention be limited to specific dimensions, it has been found that a useful form of the invention can be constructed with dimensions on the order of those recited below. The bench pad may have an overall length of about four feet and overall width of about fourteen inches. The base member may be made of wood or wood-like material about three quarters of an inch thick and the padding material may be a polyurethane or urethane foam or similar material selected from any well known and readily available types and preferably is made from a single integral block which is cut and sculpted to the desired size and shape. The cover material 34 may be a strong, durable sheet which has good resistance to water penetration to avoid leakage of perspiration into the pad. A high quality vinyl or cloth or other suitable material may be chosen for this purpose. The cover is cut in pieces according to a pattern and the pieces sewn together so that the finished cover will follow the contours of the finished bench pad. The padding material should have a density to adequately and comfortably support the body of a weight lifter during exercise. In addition, the padding is preferably cut to a size somewhat larger and thicker than the dimensions of the finished bench pad and is initially compressed by the cover 34 which is drawn tightly over the padding and the edges of base member 28 and then secured to the surface 36 of the base member by an adhesive or by staples or the like. The overall finished maximum thickness of the bench pad including the base member may be about three and one half inches when a relatively dense resilient foam is used. The apex 42 of the first concave portion 38 of the elongate portion 70 may be about thirty and a half inches from the lower end 24 of the bench pad and the apex 44 of concave portion 40 may be about eleven and a half inches from the upper end 26 of the bench pad. The width across the middle portion 60 of the third portion 58 of the bench pad may be about nine inches. It should be understood that the above dimensions and mode of construction are exemplary only and adjustments may be made to fit particular situations and persons or to utilize a more desirable material without departing from the scope of the invention.

As an additional optional feature the bench pad may be provided with a restraining belt or member. The restraining belt may be of any well known configuration, for example, a typical lap seat belt as employed in automobiles or aircraft or recreational vehicles. The belt may be made in two parts, each having one end secured to the base of the bench pad by a bolt or screw and secured together at their other ends by buckle means. A first one of such parts may preferably be provided with means of any well known type for adjusting the length of the belt for use by different persons and also with a releasable attachment device which is part of the buckle means. The other part of the belt may have an attachment tongue complementary to the releasable attachment device on the first one of such parts so that the two parts of the restraining device can be secured together to restrain extreme arching of the back during lifting exercises. In general, a slight arching of the lower back is permitted but arching which would cause the buttocks to be out of contact with the contour in the elongate portion 70 of the bench pad is undesirable and should be avoided. The restraining member may comprise a relatively wide strap portion; a buckle means which comprises a releasable attachment device and cooperating tongue; and means for securing the restraining member to the base member 28. Alternatively, the strap portion of the restraining device may be in the form of a continuous member consisting of one or more parts which would encircle both the bench pad 10 and the weight lifter's body rather than being attached to the base member. This would permit easy adjustment of the longitudinal position of the restraining member along the length of the bench pad to a position most comfortable and desirable for the user.

While I have shown and described specific embodiments of my invention, it is obvious that many variations and alterations may be made to the specific arrangements and configurations shown without departing from the scope of the invention as defined by the following claims.

I claim:

1. A bench pad for a weight lifter's bench comprising:

a first elongate portion of a first substantially uniform predetermined width;

a second portion disposed longitudinally of said first elongate portion and having a second substantially uniform predetermined width;

a third portion disposed between said first elongate portion and said second portion and connected to each of them to form an integrated bench pad having a relatively smooth continuous top surface and having opposed lateral edges lying along opposed continuous curves and said third portion positioned to be located under and to resiliently support the shoulders and neck of a person lying supine on said bench pad;

a first end of said third portion being connected to said first elongate portion and having a width substantially equal to the width of the adjoining end of said first elongate portion to which it is attached and said first elongate portion extending from the point of connection to said third portion to the lower end of said bench pad;

a second end of said third portion being connected to said second portion and having a width substantially equal to the width of the adjoining end of said second portion;

said third portion having a middle portion of a width substantially reduced from the width of each of its ends;

said third portion having a gradually reducing width from each of its ends toward said middle portion;

said second portion and the adjacent portion of said third portion having formed therein a depression having an arcuate cross section in a direction transverse to the longitudinal centerline of the bench pad and the maximum width of said arcuate cross section being such that the sides of such depression will at least partially engage the sides of the head of a person lying supine on said bench pad whereby said third portion of said bench pad will provide substantial vertical support to the shoulders and neck of a person lying supine on said bench pad with the shoulders substantially centered vertical on said middle portion and the body of such person substantially centered on the longitudinal centerline of the bench pad, the head of such person will lie in said depression and the sides of said depression will provide lateral stability the head of such person.

2. A bench pad as set forth in claim 1 wherein resilient support for a person lying on said bench pad is provided by a resilient pad of substantial thickness forming the core of the bench pad.

3. A bench pad as set forth in claim 2 wherein said resilient pad is made of a plastic or rubber foam material.

4. A bench pad as set forth in claim 2 wherein said bench pad includes a substantially rigid base constructed and arranged to permit attachment of the bench pad to a support frame.

5. A bench pad as set forth in claim 4 wherein said base is made of wood or wood-like material.

6. A bench pad as set forth in claim 1 wherein said first portion and the adjacent portion of said third portion have formed therein a depression having an arcuate cross section in a direction transverse to the longitudinal centerline of the bench pad to help provide longitudinal and lateral stability to the hips of a person lying supine on said bench pad.

7. A bench pad as set forth in claim 1 in which those outer edges of said depression which lie in a generally longitudinal direction are spaced from the adjacent outer edges of said bench pad and at least the portion of said depression falling within said third portion of the bench pad has an arcuate cross section in planes parallel to the longitudinal centerline of the bench pad.

8. A bench pad as set forth in claim 6 in which those outer edges of said depression formed in said first portion and the adjacent portion of said third portion which lie in a generally longitudinal direction are spaced from the adjacent outer edges of said bench pad and at least the portion of said depression falling within said third portion of the bench pad has an arcuate cross section in planes parallel to the longitudinal centerline of the bench pad.

9. A bench pad for a weight lifter's bench comprising:

a base of substantially rigid material;

a unitary resilient contoured pad overlying substantially the entire area of said base and supported by said base; and a substantially non-porous cover of relatively thin material overlying and conforming to the top surface of said contoured pad and the edges of said contoured pad and said base;

said bench pad being characterized by:

a reduced width portion having a vertical height substantially equal to the maximum vertical height of the bench pad to provide substantial resistance to compression and which underlies at least a part of the shoulders and cervical body portion of a person lying supine on said bench pad thereby permitting a wide downward range of motion of the shoulder blades and full expansion of the pectoral muscles during bench press exercises and which reduced width portion will be in line with the overhanging arm and shoulder of a person lying chest down on said bench pad to perform bent over one arm dumbbell pulls thereby to provide suitable support for the chest and shoulder of such person while reducing the probability of undesired contact of the weight being lifted with the bench pad;

an upper substantially arcuate depression extending from an upper end of said contoured pad toward and into an upper adjacent end of said reduced width portion, said depression being positioned to receive the head of a person lying supine on said bench pad whereby said bench pad will provide substantial vertical support to the shoulders and neck of a person lying supine on said bench pad with the shoulders substantially vertically centered on said reduced width portion and attempting to lift weights in the course of bench press exercises and will provide lateral stability to the head of such person.

10. A bench pad as described in claim 9 wherein the contoured pad includes a lower substantially arcuate depression extending from a lower end of said contoured pad toward and into a lower adjacent end of said reduced width portion for supporting and stabilizing the hips and lower back of a person lying supine on said bench pad.

11. A bench pad as set forth in claim 2 in which the core of the bench pad is formed from a single integral piece of material.

12. A bench pad as set forth in claim 10 in which the contoured pad is formed from a single integral piece of material.

13. A bench pad for a weight lifter's bench comprising:

a first elongate portion of a first substantially uniform predetermined width;

a second portion disposed longitudinally of said first elongate portion and having a second substantially uniform predetermined width;

a third portion disposed between said first elongate portion and said second portion and connected to each of them to form an integrated bench pad having a relatively smooth continuous top surface and having opposed lateral edges lying along opposed continuous curves and said third portion positioned to be located under and to resiliently support the shoulders and neck of a person lying supine on said bench pad;

a first end of said third portion being connected to said first elongate portion and having a width substantially equal to the width of the adjoining end of said first elongate portion to which it is attached and said first elongate portion extending from the point of connection to said third portion to the lower end of said bench pad;

a second end of said third portion being connected to said second portion and having a width substantially equal to the width of the adjoining end of said second portion;

said third portion having a middle portion of a width substantially reduced from the width of each of its ends;

said third portion having a gradually reducing width from each of its ends toward said middle portion; and said first portion and the adjacent portion of said third portion having formed therein a depression having an arcuate cross section in a direction transverse to the longitudinal centerline of the bench pad and the maximum width of said arcuate cross section being such that the sides of such depression will at least partially engage the sides of the hips of a person lying supine on said bench pad whereby said third portion of said bench pad will provide substantial vertical support to the shoulders and neck of a weight lifter lying supine on said bench pad with the shoulders substantially centered vertically on said middle portion and the body of the weight lifter substantially centered on the longitudinal centerline of the bench pad and said depression will provide lateral stability to the hips of such weight lifter.

* * * * *